US009242249B2

(12) United States Patent
Baker

(10) Patent No.: US 9,242,249 B2
(45) Date of Patent: Jan. 26, 2016

(54) MAGNETIC SCREEN

(76) Inventor: William John Baker, Thirroul (AU)

( * ) Notice: Subject to any disclaimer, the term of this patent is extended or adjusted under 35 U.S.C. 154(b) by 506 days.

(21) Appl. No.: 13/698,790

(22) PCT Filed: May 2, 2011

(86) PCT No.: PCT/AU2011/000507

§ 371 (c)(1),
(2), (4) Date: Feb. 5, 2013

(87) PCT Pub. No.: WO2011/143688

PCT Pub. Date: Nov. 24, 2011

(65) Prior Publication Data

US 2013/0199984 A1 Aug. 8, 2013

(30) Foreign Application Priority Data

May 19, 2010 (AU) ..... 2010902197
Mar. 4, 2011 (AU) ..... 2011900789

(51) Int. Cl.
*B03C 1/02* (2006.01)
*B03C 1/28* (2006.01)
*B03C 1/033* (2006.01)

(52) U.S. Cl.
CPC ..... *B03C 1/02* (2013.01); *B03C 1/0332* (2013.01); *B03C 1/284* (2013.01); *B03C 1/286* (2013.01); *B03C 2201/16* (2013.01); *B03C 2201/18* (2013.01); *B03C 2201/20* (2013.01); *B03C 2201/22* (2013.01); *B03C 2201/28* (2013.01)

(58) Field of Classification Search
CPC ..... B03C 1/02; B03C 1/0332; B03C 1/26; B03C 1/28; B03C 1/284; B03C 1/286; B03C 2201/16; B03C 2201/18; B03C 2201/20; B03C 2201/22; B03C 2201/28; B07B 1/00; B07B 1/12; B07B 1/14; B07B 1/16; B07B 1/46; B07B 1/4636; B07B 1/4609; C02F 1/481; H01F 7/0252
USPC ..... 210/222, 695
See application file for complete search history.

(56) References Cited

U.S. PATENT DOCUMENTS

| | | | | |
|---|---|---|---|---|
| 5,190,159 | A * | 3/1993 | Barker | 209/223.2 |
| 5,316,151 | A * | 5/1994 | Thompson | 209/223.1 |
| 6,902,066 | B2 * | 6/2005 | Yang | 209/223.1 |
| 8,132,674 | B1 * | 3/2012 | Allore et al. | 209/223.1 |
| 2011/0203976 | A1 * | 8/2011 | Baker | 209/214 |

FOREIGN PATENT DOCUMENTS

| | | | | |
|---|---|---|---|---|
| AU | 2007100714 | A4 * | 8/2007 | B07B 1/46 |
| WO | WO 2009124342 | A1 * | 10/2009 | |

* cited by examiner

*Primary Examiner* — David C Mellon
(74) *Attorney, Agent, or Firm* — Jansson Munger McKinley & Kirby Ltd.

(57) ABSTRACT

A magnetic screen assembly (13). The assembly (13) is to be located in a duct (10) to screen a flowable substance passing in a direction (11). The assembly (13) has a screening position (A) so that the substance passes through the screen, and a cleaning position (B) at which the screen assembly (13) is spaced outwardly relative to the housing (12) to facilitate cleaning of the assembly (13).

6 Claims, 7 Drawing Sheets

MAGNETIC SCREEN

TECHNICAL FIELD

The present invention relates to magnetic separation devices that separate ferrous and other magnetic contaminants from a stream of material passing through the device.

BACKGROUND OF THE INVENTION

Disclosed in Australian Innovation Patent No. 2007100714 is a variable aperture screen. The screen has a base with a plurality of magnetic bars that are spaced by apertures. Steel items, in the material passing through the screen, are removed by being attracted to the bars. The bars consist of two sets, with relative movement between the sets adjusting the apertures between the bars. Each set of bars is mounted on a base so that the bars of each set are moved in unison.

A disadvantage of the above described screen is that it is generally complex and therefore expensive to manufacture. A further disadvantage is that frequently a set of bars that is being adjusted may be difficult to move.

Many situations exist in the Food industry where, because of increased regulation and standards, it becomes necessary to upgrade existing older style grate type magnets. A number of problems exist in respect of carrying out the upgrade, those problems include:

1. Existing old type grate magnets are often in a housing and removable as a 'drawer' for external cleaning. Where access is not ideal, this can be difficult even dangerous.
2. The grate bars may be covered by non magnetic "sleeves" and the magnet elements withdrawn substantially out of the sleeves until the extracted magnetics drop off Sleeves reduce available magnetic strength.
3. The magnetic grate bars may be pulled through external cleaning devices until collected magnetics material drop off. If cleaning devices are tight and efficient, pulling a number of bars simultaneously through cleaning devices is difficult unless power assisted.

Due to varying product characteristics and lump sizes it is difficult for manufacturers of grate magnets to initially propose an ideal gap between magnet bars which both minimizes blockage and maximizes magnetic separation efficiency. Prior devices provide long horizontal slot/s or numbers of holes into which bars can be added to adjust the gap or removed to increase the gap between the bars. Uncovered holes or portion of slots is also not suitable for hygienic applications. Because modern magnet bars are extremely powerful and forcefully attracted to each other, it is unsafe and impractical to completely remove or unscrew such bars in order to effect gap adjustment.

In a column of falling material, there may be different densities of material. The centre of the column may be denser than the extremities.

Issues calling for replacement of grate magnets include:

Lack of magnetic strength as in the case of old style or "sleeve type magnets"

Difficulty of cleaning where magnet bars ends are bounded by or attached to a "frame".

Difficulty in removing, replacing and cleaning a "drawer" type grate magnet.

Lack of magnetic coverage of the product stream because bars are too widely spaced.

Product blocking the grate due to the magnetic bars being too close to each other.

Unequal abrasive wear on the outer tube containing the magnets.

The existing grate not being sufficiently hygienic to satisfy today's food grade standard.

In the following description a screen is also intended to mean a grate.

Magnetic separation devices are known in which a substance (such as a gas, liquid or powder) is passed through the device for the purposes of removing ferrous and other magnetic materials. These previous devices have a number of magnetic fingers that extend transverse of the material flowing through the device.

A first disadvantage of known liquid or powder magnetic separation devices is that they are difficult to clean. A further disadvantage is that it is often necessary to support the magnetic bars at both ends, that is the bars are attached to an end plate as well to a door or lid. A still further disadvantage is that in the use of high powered magnets, when they are being placed in a machined outer housing of the device, the magnets are attracted and hold tightly to the sides of the device. This causes difficulties in respect of sealing and centrally placing the lid. The effect is a problem when the housing is a machined casting and becomes work hardened and therefore magnetically susceptible even though it is an austenitic stainless steel.

OBJECT OF THE INVENTION

It is the object of the present invention to overcome or substantially ameliorate at least one of the above disadvantages or problems.

SUMMARY OF THE INVENTION

There is disclosed herein a screen including:

a base;

a plurality of magnetic bars mounted on the base so as to be supported thereby, the bars being generally parallel and transversely spaced so as to provide an aperture between each adjacent pair of bars, each aperture having a width that extends between the adjacent pair of bars; and wherein the bars are arranged in a first set and a second set, with at least two of the bars, of at least one of the sets, each being independently moveable relative to the base in a direction generally transverse of the bars to adjust the aperture size by altering said width.

Preferably, each of the first set of bars and/or each of the second set of bars is mounted on the base each for independent movement relative to the bars.

Preferably, the screen is adapted for flow of a substance through the screen in a predetermined direction generally normal to the bars, with movement of the first and/or second set of bars being in said direction.

Preferred, said base is a single support member, with each of the bars supported by the support member.

Preferably, the support member is a plate.

Preferably, the base has a plurality of slots that provide for movement of the first and/or second set of bars relative to the base.

Preferably, said slots are elongated in said direction.

There is further disclosed herein a magnetic screen assembly to be mounted in a duct along which a flowable substance is to pass so as to pass through the screen, the assembly including:

a base to engage the duct so as to be movable relative thereto between a screening position at which the substance passes through the screen assembly, and a cleaning position at which the base is to be spaced outwardly of the duct to provide for cleaning of the assembly; and a plurality of magnetic bars attached to and supported by the base so as to extend longitudinally therefrom in a cantilever manner from the base.

Preferably, said base includes an end wall to which the bars are attached and extend from, and a pair of side members extending from and fixed to the base, the side members extending from the base in a direction generally parallel to the bars.

Preferably, each of the bars extends from the end wall in a cantilevered manner so as to be solely supported thereby.

Preferably, each of the side members terminates at a position remote from the end wall in an end extremity, with the bars being exposed adjacent the end extremities for cleaning purposes.

There is further disclosed herein in combination a duct, through which a substance is to flow in a predetermined direction, and said assembly, said duct providing a housing within which the assembly is located so as to be movable relative thereto between the screening position and the cleaning position, with said bars extending generally transverse relative to said direction.

Preferably, the base is movable between the screening position and the cleaning position in a direction generally parallel to the bars.

Preferably, said housing has a support to support the base in the cleaning position.

Preferably, said housing includes guides to aid in movement of the base between the screening and cleaning positions.

Preferably, a tray is attached to the housing and is located below the bars when the base is in the cleaning position.

Preferably, said housing has an opening through which the bars move when the base moves from the screening position to the cleaning position, with the base spaced inwardly of the housing from the opening when the base is in the cleaning position.

There is also disclosed herein a magnetic separation device including:

a hollow body providing a chamber with an end wall, an inlet to the chamber and an outlet to the chamber, with the inlet and outlet arranged, for the flow of material therebetween so that material passes through the chamber in a flow direction;

a magnetic assembly including a base, a plurality of elongated magnets attached to the base so as to extend therefrom in a magnet predetermined direction, with at least some of the magnets terminating with a free end; and wherein said base is located adjacent said end wall so that said magnets extend into said chamber so that said magnet predetermined direction is generally transverse of said flow direction.

Preferably, said device has an opening opposite said end wall via which said assembly is moved to be located in said chamber or removed for cleaning.

Preferably, said separator includes a lid to close said opening.

Preferably, said plate has a plurality of apertures through which threaded fasteners pass to secure the magnets to the base.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENTS

Figures 1, 2:
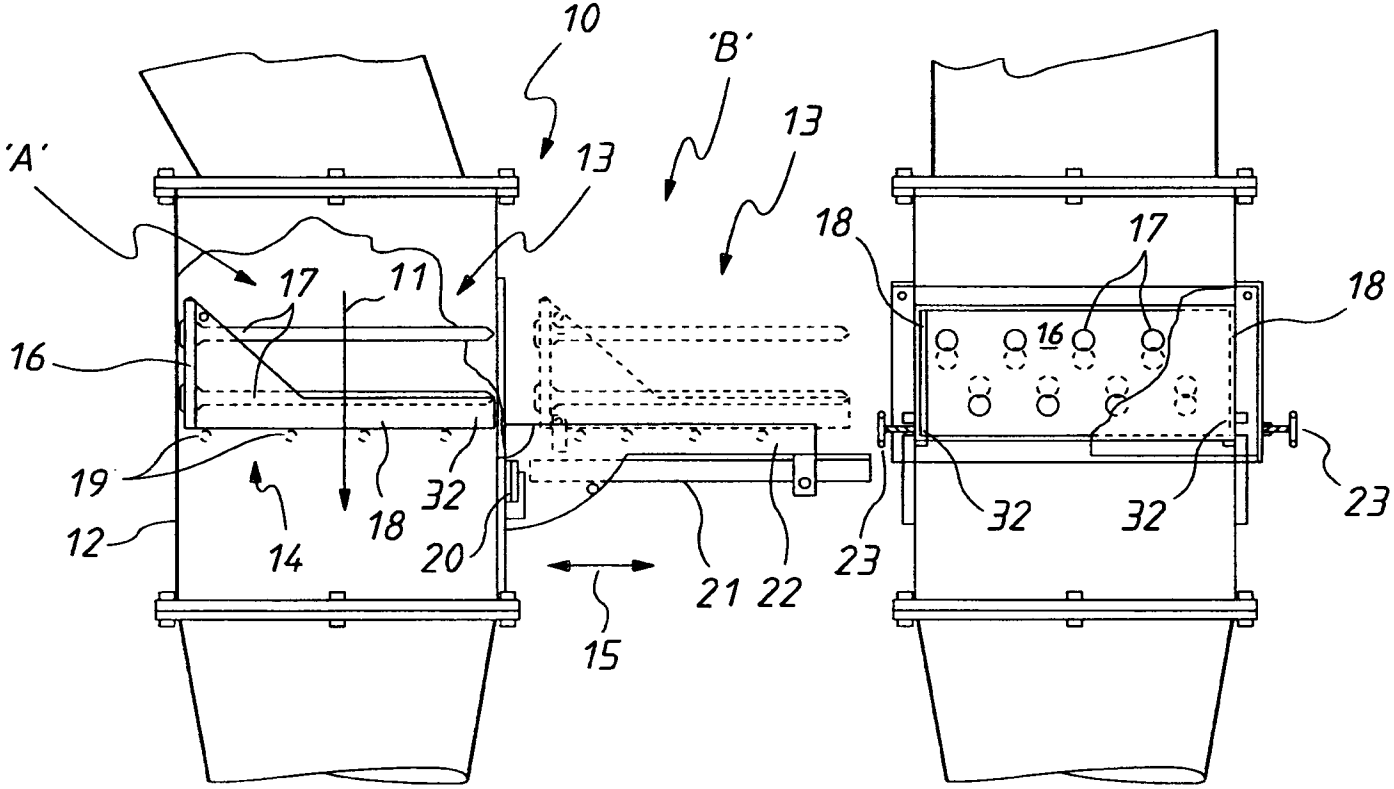
FIG. 1 is a schematic side elevation of a duct with a magnetic screen.
FIG. 2 is a schematic front elevation of the duct and screen of FIG. 1.

In FIGS. 1 to 6 of the accompanying drawings there is schematically depicted a duct 10 along which a flowable substance, such as particles or a fluid, may pass in the direction 11. The duct 10 includes a housing 12 within which there is located a magnetic screen assembly 13. The magnetic screen assembly 13 is illustrated in a screening position (A) so that the substance passes through the screen assembly, and a cleaning position (B) at which the screen assembly 13 is spaced outwardly relative to the housing 12 to facilitate cleaning of the assembly 13.

The assembly 13 includes a base 14 that is supported by the housing 12 for movement in a direction 15 that is generally perpendicular to the direction 11. The base 14 has an end wall 16 to which there is attached a plurality of magnetic bars 17 that extend in a cantilevered manner from the end wall 16. Fixed to the end wall 16 are two side members 18 that are generally parallel and transversely spaced and are joined by the base 16. The side members 18 extend longitudinally generally perpendicular to the direction 11, that is parallel to the direction 15. Preferably, the housing 12 has supports and/or guides in the form of rollers 19 that support the assembly 13 for movement between its two positions.

Preferably, there is fixed to the housing 12 a mounting 20 that supports a tray 21 and a pair of support members 22 upon which the base 14 and therefore the assembly 13 rests when in the cleaning position. Preferably, one or more threaded members 23 are attached to the members 22 and are moved into engagement with the supports 18 to retain the assembly 13 in the cleaning position.

Preferably, the tray and/or support members 22 are removably attached to the housing 12 by means of the mounting 20.

Figure 4:
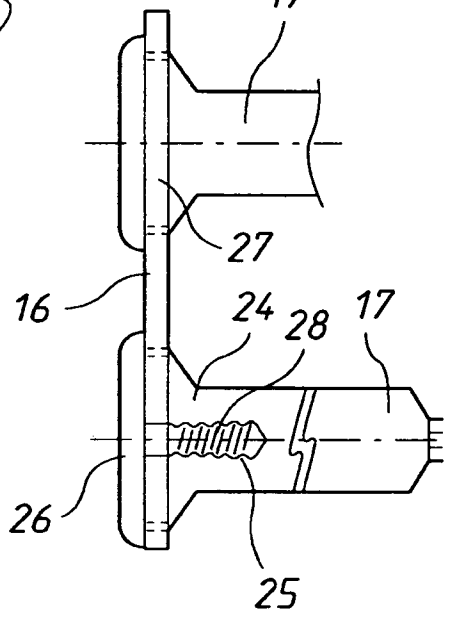
FIG. 4 is a schematic side elevation of the portion of FIG. 3.
Figure 3:
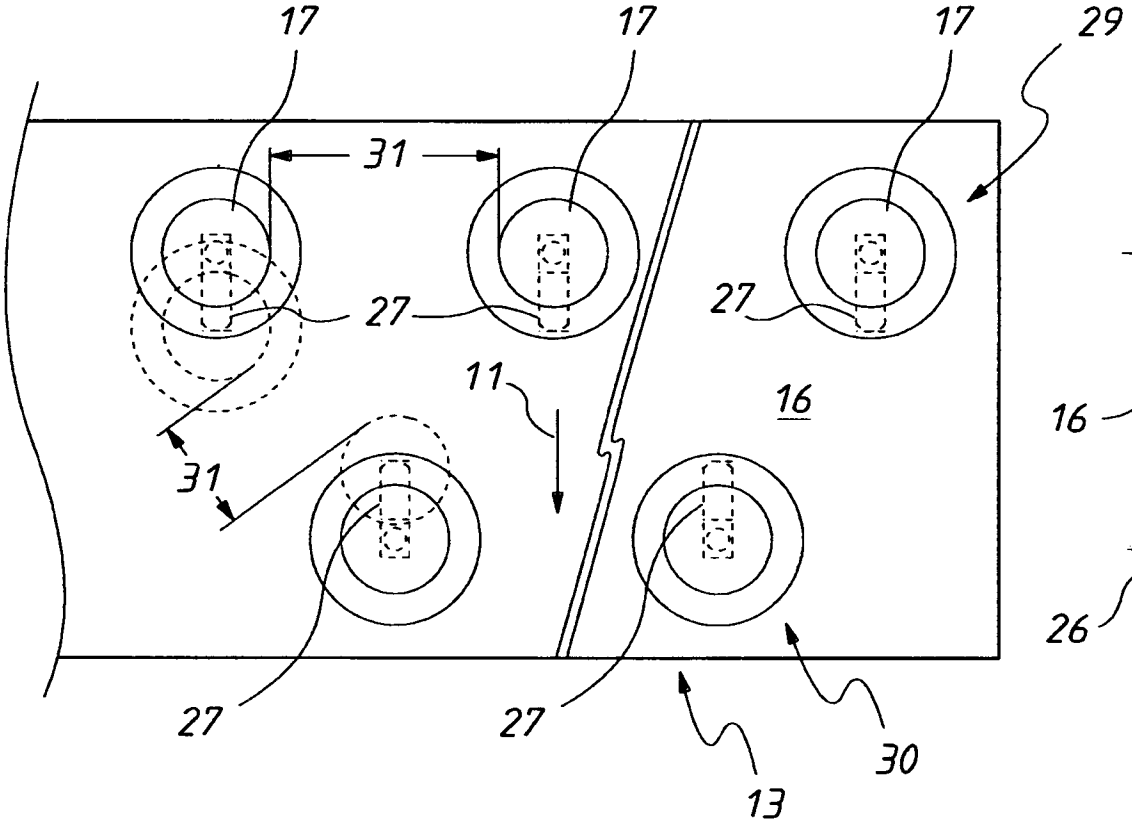
FIG. 3 is a schematic front elevation of the portion of the screen of FIGS. 1 and 2.
Figures 5, 6:
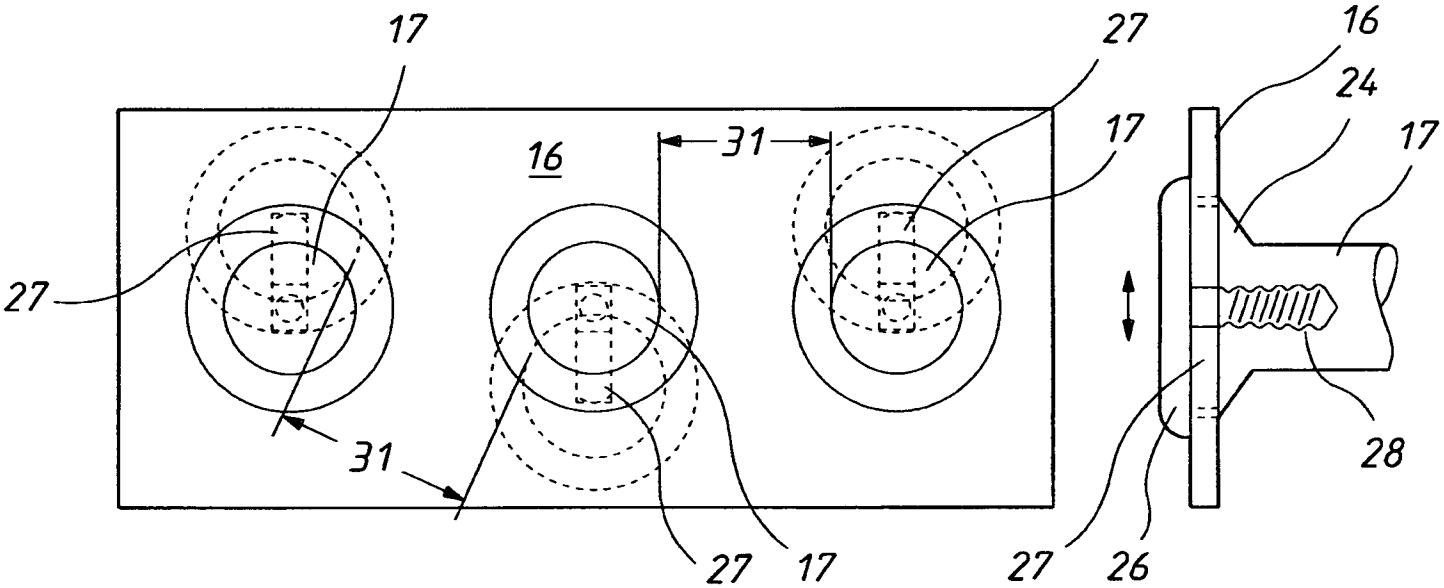
FIG. 5 is a schematic front elevation of an alternative construction employed in the screen of FIGS. 1 and 2.
FIG. 6 is a schematic side elevation of the alternative construction of FIG. 5.
Figure 8:
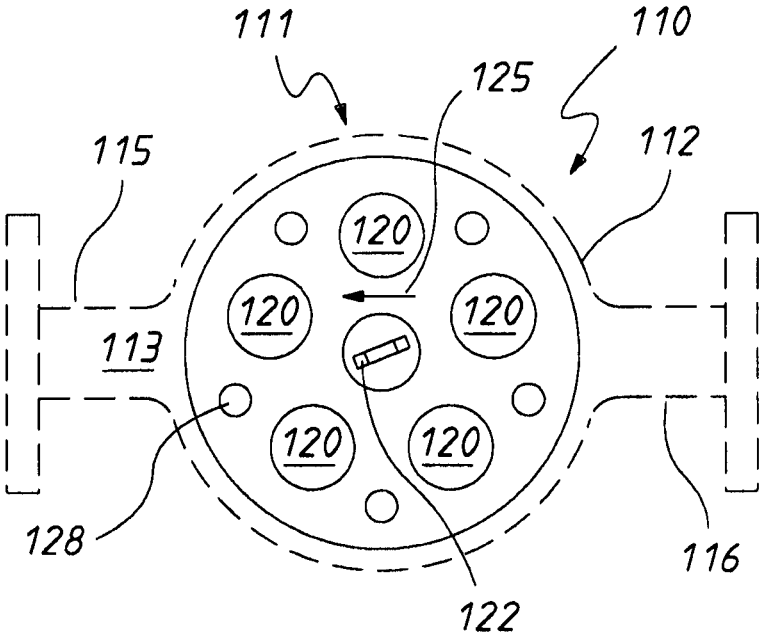
FIG. 8 is a schematic top plan view of the device of FIG. 7.
Figure 7:
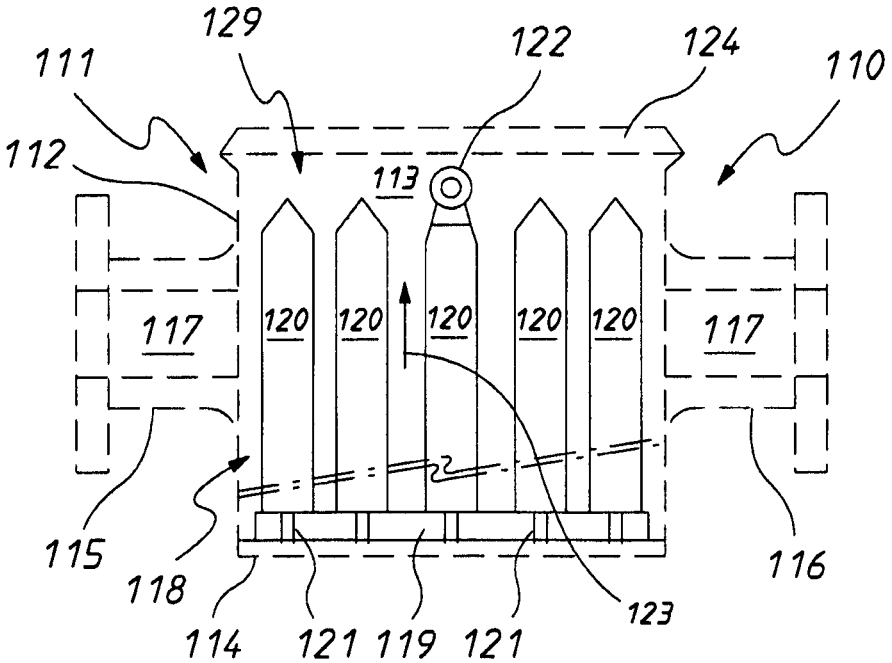
FIG. 7 is a schematic side elevation of a duct with a hollow body and a magnetic separation device.
Figure 9:
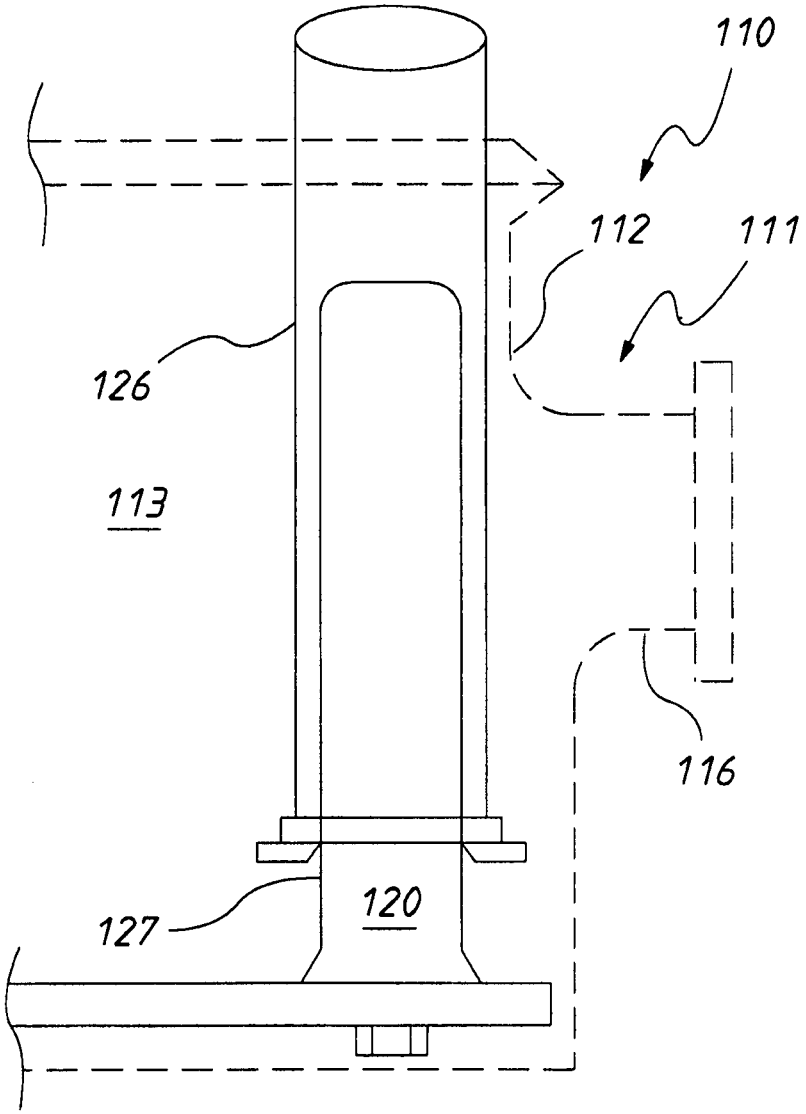
FIG. 9 is a schematic enlarged view of portion of the device of FIGS. 7 and 8.
Figure 10:
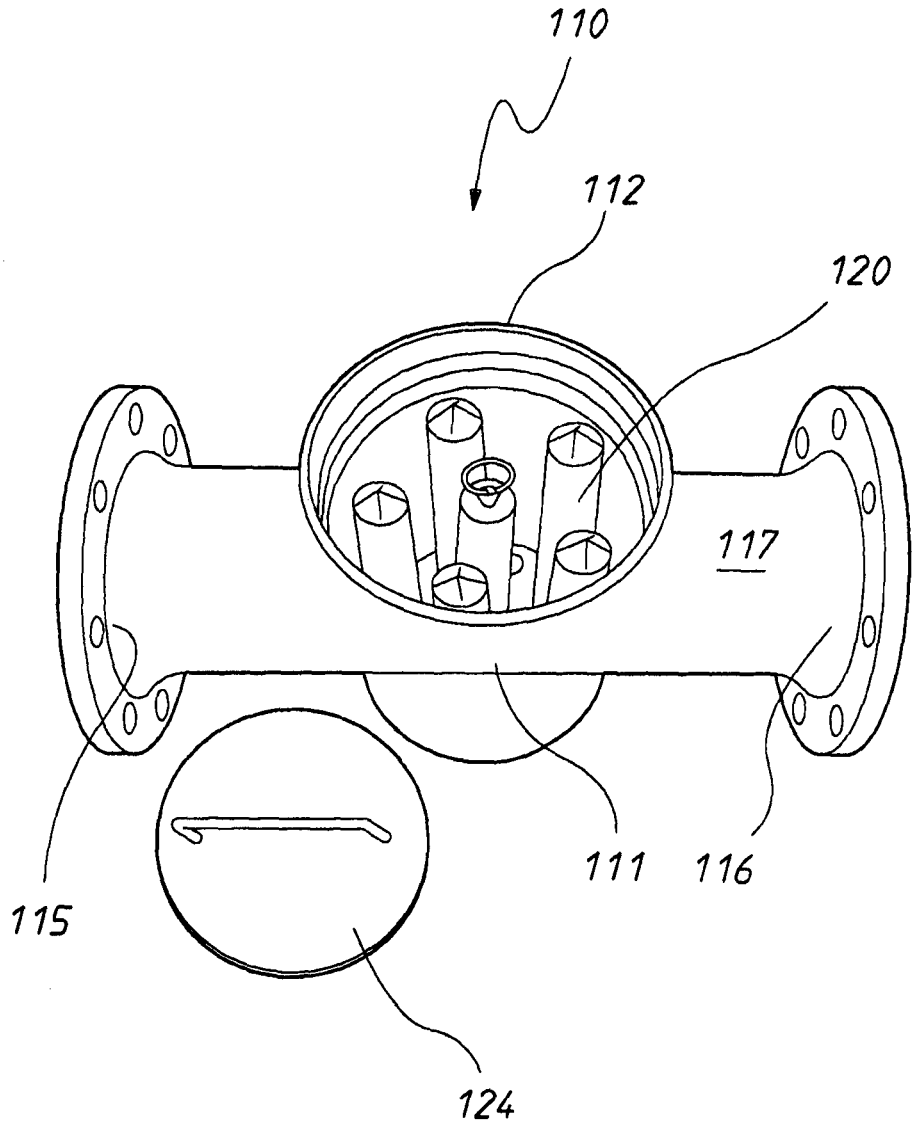
FIG. 10 is a schematic isometric view of the device of FIGS. 7 to 9.
Figure 11:
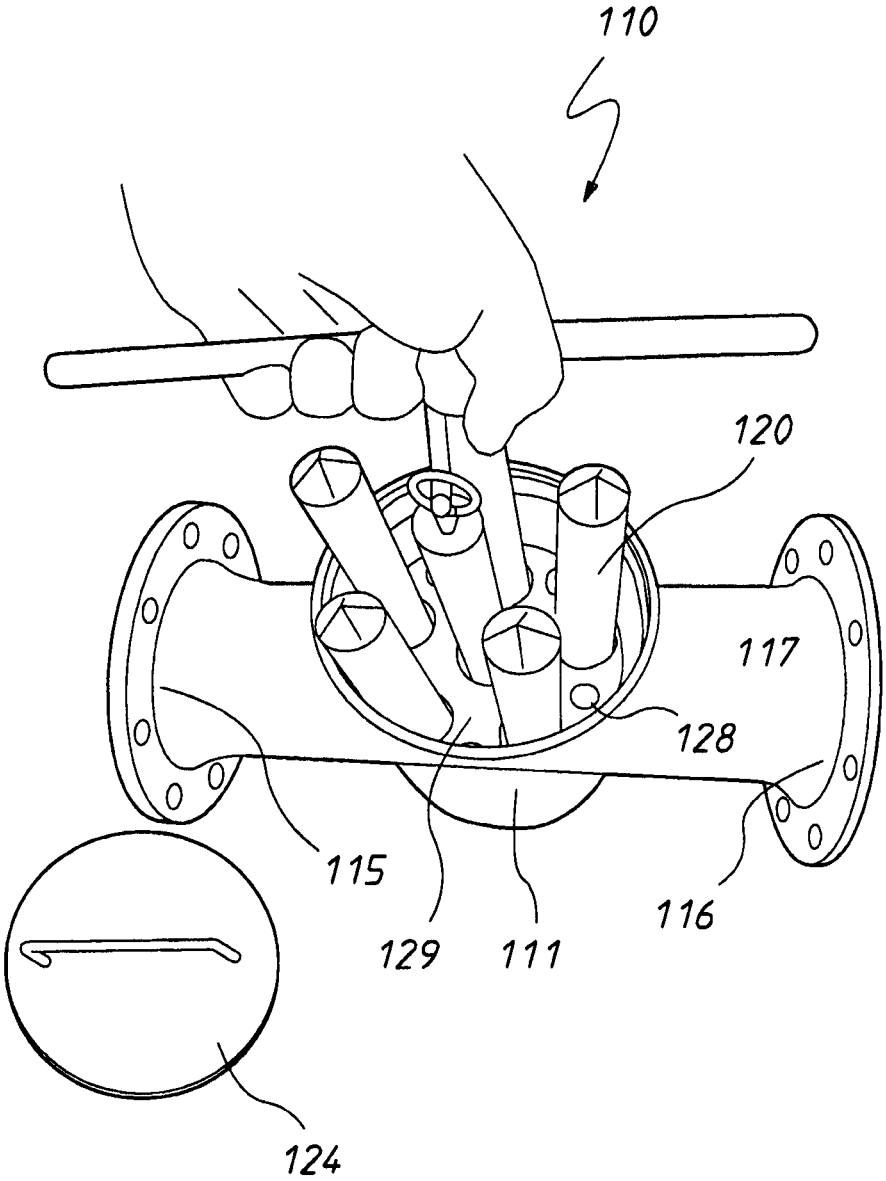
FIG. 11 is a further schematic isometric view of the device of FIGS. 7 and 8 with a magnetic assembly being moved with respect to the outer housing of the device.

In the embodiment of FIGS. 3, 4 and 5, the bars 17 are attached to the end wall 16 so as to extend therefrom in a cantilever manner. That is, the bars 17 have end portions 24 fixed to the end wall 16 so as to extend longitudinally therefrom. Preferably, each of the bars 17 is attached to the end wall 16 so as to extend generally perpendicular therefrom. Each end portion 24 has a threaded passage 25 within which there is engaged a threaded fastener 26 so that the end wall 16 is clamped between the end portion 24 and the threaded member 26 to thereby secure each bar 17 to the end wall 16. That is, each bar 17 is only supported by the end wall 16.

The end wall 16 includes a plurality of slots 27 that extend in the direction 11 through which the threaded shaft 28 of the threaded fastener 26 passes to engage the end portion 24. By being elongated in the direction 11, the slots 27 provide for independent relative movement between each of the bars 17 and the end wall 16. However it should be appreciated that the end portion 24 and threaded fastener 26 are shaped so that when the bars 17 are located in their uppermost and lowermost positions, the slots 24 are still covered. This prevents the substance passing along the duct 10 becoming lodged and retained in the slots 27. It should be appreciated that in the embodiment of FIGS. 3, 4 and 5, the bars 17 are located in an upper first set 29 and a lower second set 30. Both sets 29 and 30 may be adjustable and/or one of sets 29 or 30 may be fixed stationary to the wall 16 so that the other set 29 or 30 is adjustable. By moving the bars 17 along the slots 27, the aperture between adjacent bars 17 can be varied by varying the width 31 of the aperture between adjacent bars 17.

By being able to adjust the distance between adjacent bars 17 and therefore the aperture between adjacent bars 17, the assembly 13 can be adjusted to suit the substance passing through the duct 10.

In the embodiment of FIGS. 3 and 4, the slots 27 associated with the set 29 are spaced from the slots 27 associated with the set 30 in the direction 11. However in the embodiment of FIGS. 5 and 6, the slots 27 at least partly overlap in a direction transverse of the direction 11.

In the above described preferred embodiments, the base 14 is an open ended drawer, that is the end wall 16 and side members 18 provide a draw which is opened between the end extremities 32 of the members 18. This enables the use of a tubular cleaning tool that is to pass along each of the bars 17 (when in the cleaning position) to remove material attracted to the bars 17. The removed material is then collected in the tray 21.

In FIGS. 7 to 11 of the accompanying drawings there is schematically depicted a magnetic separation device 110. The device 110 includes a hollow body 111 including a peripheral wall 112 which in this embodiment is cylindrical. The wall 112 surrounds a chamber 113 having an end wall 114. Extending from one side of the wall 112 is an inlet 115, while an outlet 116 extends from the opposite side of wall 112. The inlet 115 and outlet 116 each have a passage 117 providing for the flow of material through the device 110, in particular for the flow of material through the chamber 113.

Mounted in the chamber 113 is a magnetic assembly 118 that includes a base 119 from which there extends a plurality of elongated magnets 120, each of the magnets 120 terminating with a free end extremity spaced from the base 119. In this embodiment the base 119 is generally flat, together with the end wall 114 so that the base 119 may sit flush against the end wall 114. More particularly if the device 110 is oriented so that the magnets 120 extend vertically, then the end wall 114 and base 119 are generally horizontally oriented.

The magnets 120 are secured to the base 119 by means of threaded fasteners 121 that pass through passages in the base 119 to threadably engage in threaded passages in an end extremity of the magnets 120. Preferably, the magnets 120 are each flared at their end adjacent the base 119 to aid in securing the magnets 120 securely fixed to the base 119.

Preferably, the central magnet 120 is provided with an eyelet 122 that is engagable with a hook tool to aid for insertion and removal of the assembly 118 with respect to the chamber 113.

The body 111 has an upper opening 129 (surrounded by the upper lip of the cylindrical wall 112) that is closed by means of a lid 124. The assembly 118 is movable through the opening 129 for insertion and removal.

The magnets 120 extend away from the base 119 in a predetermined direction 123, while material passes through the chamber 113 in a predetermined flow direction 125. The direction 125 is generally transverse (and more preferably normal) to the direction 123. Accordingly the magnets 120 extend transverse the direction 125 of flow of material through the chamber 113.

Each of the magnets 120 is cleanable by means of a cleaning tool 126. The cleaning tool 126 is of a hollow cylindrical shape so that it may pass along and clean the external surface 127 of each magnet 120. After removal of the assembly 118 from the chamber 113 the tool 126 passes down each magnet 120 to move collected material towards the base 119.

Preferably, the base 119 has apertures 128 that allows liquid to drain past the base 119 when it moves through the chamber 113.

The invention claimed is:

1. A screen comprising:

a base;

a plurality of magnetic bars mounted on the base so as to be supported by the base, the magnetic bars being generally parallel and transversely spaced so as to provide an aperture between each adjacent pair of magnetic bars, each aperture having a size with a width that extends between adjacent pair of magnetic bars; and the magnetic bars being arranged in a first set and a second set, with at least one of the first and second sets having at least two of the magnetic bars, each of the magnetic bars being independently movable relative to the base in a direction generally transverse of the magnetic bars to adjust the aperture size by altering said width, the base including a plurality of slots respectively corresponding with the magnetic bars, the slots allowing for movement of the magnetic bars relative to the base.

2. The screen of claim 1 wherein the first set of magnetic bars and/or the second set of magnetic bars is independently moveable relative to the base.

3. The screen of claim 1 wherein the screen is adapted for flow of a substance through the screen in a predetermined direction generally normal to the magnetic bars, with movement of the first and/or second set of magnetic bars being in said predetermined direction.

4. The screen of claim 1 wherein said base is a single support member, with each of the magnetic bars supported by the support member.

5. The screen of claim 4 wherein the support member is a plate.

6. The screen of claim 1 wherein said slots are elongated in a predetermined direction.

* * * * *